US010641224B2

(12) United States Patent
Scheffel et al.

(10) Patent No.: US 10,641,224 B2
(45) Date of Patent: May 5, 2020

(54) DECOUPLING ELEMENT FOR A FUEL-INJECTION DEVICE

(71) Applicant: Robert Bosch GmbH, Stuttgart (DE)

(72) Inventors: Martin Scheffel, Vaihingen (DE); Wilhelm Reinhardt, Oetisheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/526,844

(22) PCT Filed: Oct. 19, 2015

(86) PCT No.: PCT/EP2015/074144
§ 371 (c)(1),
(2) Date: May 15, 2017

(87) PCT Pub. No.: WO2016/096200
PCT Pub. Date: Jun. 23, 2016

(65) Prior Publication Data

US 2017/0328325 A1 Nov. 16, 2017

(30) Foreign Application Priority Data

Dec. 16, 2014 (DE) ..... 10 2014 225 988

(51) Int. Cl.
*F02M 63/02* (2006.01)
*F02M 61/14* (2006.01)
(Continued)

(52) U.S. Cl.
CPC ..... *F02M 63/026* (2013.01); *F02D 41/3845* (2013.01); *F02M 55/04* (2013.01);
(Continued)

(58) Field of Classification Search
CPC ..... F02M 61/14; F02M 61/16; F02M 63/026; F02M 55/04; F02M 2200/50; F02M 55/004; F02M 69/38; F02D 41/3845
See application file for complete search history.

(56) References Cited

U.S. PATENT DOCUMENTS 6,009,856 A 1/2000 Smith, III et al.
7,293,550 B2 * 11/2007 Beardmore ..... F02M 61/14 123/470
(Continued)

FOREIGN PATENT DOCUMENTS

CN 101784787 A 7/2010
CN 102245890 A 11/2011
(Continued)

OTHER PUBLICATIONS

International Search Report dated Dec. 1, 2015, of the corresponding International Application PCT/EP2015/074144 filed Oct. 19, 2015.

*Primary Examiner* — Xiao En Mo
(74) *Attorney, Agent, or Firm* — Norton Rose Fulbright US LLP; Gerard Messina

(57) ABSTRACT

A decoupling element for a fuel-injection device has a low-noise and pivotable construction. The fuel-injection device includes at least a fuel injector and a receiving bore in a cylinder head for the fuel injector as well as the decoupling element between a valve housing of the fuel injector and a wall of the receiving bore. The decoupling element is in the form of a ring, in particular a closed ring, which has a lower end face that sits on a shoulder of the receiving bore, and which has an upper end face that rises conically from radially outside toward radially inside and is in intimate contact with a spherically curved shoulder area of the valve housing of the fuel injector. The fuel-injection device is particularly suitable for the direct injection of fuel into a combustion chamber of a mixture-compressing combustion engine having externally supplied ignition.

20 Claims, 5 Drawing Sheets

(51) Int. Cl.

| | |
|---|---|
| ***F02M 61/16*** | (2006.01) |
| ***F02D 41/38*** | (2006.01) |
| ***F02M 55/04*** | (2006.01) |
| *F02M 55/00* | (2006.01) |
| *F02M 69/38* | (2006.01) |

(52) U.S. Cl.
CPC ..... *F02M 61/14* (2013.01); *F02M 61/166* (2013.01); *F02M 61/168* (2013.01); *F02M 55/004* (2013.01); *F02M 69/38* (2013.01); *F02M 2200/09* (2013.01); *F02M 2200/50* (2013.01)

(56) References Cited

U.S. PATENT DOCUMENTS

2002/0148446 A1 10/2002 Gmelin
2004/0060544 A1* 4/2004 Reiter ..... F02M 61/14 123/470
2011/0094478 A1* 4/2011 Scheffel ..... F02M 61/14 123/470

FOREIGN PATENT DOCUMENTS

| | | | |
|---|---|---|---|
| CN | 103987953 | A | 8/2014 |
| DE | 10027662 | A1 | 12/2001 |
| DE | 10038763 | A1 | 2/2002 |
| DE | 10108466 | A1 | 9/2002 |
| DE | 102004060983 | A1 | 6/2006 |
| EP | 1223337 | A1 | 7/2002 |
| GB | 803523 | A | 10/1958 |
| JP | H07-71428 | A | 3/1995 |
| JP | H11280618 | A | 10/1999 |
| JP | 2009191920 | A | 8/2009 |
| JP | 2010127193 | A | 6/2010 |
| JP | 2011122692 | A | 6/2011 |
| WO | 9900595 | A2 | 1/1999 |
| WO | 2013156258 | A1 | 10/2013 |
| WO | 2014079609 | A1 | 5/2014 |

* cited by examiner

DECOUPLING ELEMENT FOR A FUEL-INJECTION DEVICE

FIELD

The present invention is based on a decoupling element for a fuel-injection device.

BACKGROUND INFORMATION

FIG. 1 shows a conventional fuel-injection device by way of example. Here, a flat intermediate element is provided on a fuel injection valve installed in a receiving bore of a cylinder head of an internal combustion engine. In the conventional manner, such intermediate elements are positioned as support elements in the form of a washer on a shoulder of the receiving bore of the cylinder head. Intermediate elements of this kind are meant to compensate for production and installation tolerances and to ensure that transverse forces will not affect the mounting even if the fuel injector is positioned at a slight tilt. The fuel-injection device is especially suitable for use in fuel-injection systems of mixture-compressing internal combustion engines having externally supplied ignition.

Another type of simple intermediate element for a fuel-injection device is described in German Patent No. DE 101 08 466 A1. The intermediate element is a washer having a circular cross-section, which is disposed in a region in which both the fuel injector and the wall of the receiving bore in the cylinder head extend in the form of a truncated cone, the washer being used as a compensating element for mounting and supporting the fuel injector.

Intermediate elements for fuel-injection devices that are more complicated and much more resource-intensive in the production are also described in German Patent Nos. DE 100 27 662 A1 and DE 100 38 763 A1, and European Patent No. EP 1 223 337 A1, among others. All of these intermediate elements are distinguished by being constructed of multiple parts or multiple layers and in some cases are meant to assume sealing and damping functions. The intermediate element described in German Patent No. DE 100 27 662 A1 includes a base and carrier body, into which a sealing means that is penetrated by a nozzle body of the fuel injector is inserted. In German Patent No. DE 100 38 763 A1, a multi-layered compensating element is described, which is composed of two rigid rings and an elastic intermediate ring sandwiched between them. This compensating element allows both for tilting of the fuel injector in relation to the axis of the receiving bore over a relatively large angular range and a radial displacement of the fuel injector from the center axis of the receiving bore.

An intermediate element that likewise has multiple layers is also described in European Patent No. EP 1 223 337 A1; this intermediate element is composed of a plurality of washers which are made from a damping material. The damping material of metal, rubber or PTFE is selected and configured so that noise damping of the vibrations and the noise generated by the operation of the fuel injector is possible. However, the intermediate element must have four to six layers for this purpose in order to achieve the desired damping effect.

Furthermore, to reduce noise emissions, U.S. Pat. No. 6,009,856 A1 suggests to surround the fuel injector by a sleeve and to fill up the created interspace with an elastic, noise-damping mass. However, this type of noise damping is very resource-intensive, difficult to assemble and costly.

SUMMARY

An example decoupling element in accordance with the present invention may have the advantage that better noise damping is achieved with the aid of a very simple design. The decoupling element has a non-linear, progressive spring characteristic that results in multiple positive and advantageous aspects during the installation of the decoupling element in a fuel-injection device including injectors for a direct injection of fuel. The low rigidity of the decoupling element in the idling operating point allows for effective decoupling of the fuel injector from the cylinder head and thereby markedly reduces the noise radiated by the cylinder head in the noise-critical idling operation. The high rigidity at a nominal system pressure ensures an overall low movement of the fuel injector during the vehicle operation and thereby ensures not only the durability of the sealing rings serving as combustion-chamber seal and as seals from the fuel rail but also a stable spray-discharge point of the fuel spray in the combustion chamber, which is decisive for the stability of some combustion methods.

The decoupling element is distinguished by low height, which allows for its use also when space is limited. The decoupling element furthermore has long-term strength even at high temperatures. The decoupling element is able to be produced in a very simple and cost-effective manner from the standpoint of production technology. The entire suspension of the system made up of fuel injector and decoupling element may furthermore be installed and uninstalled in a simple and rapid manner.

Advantageous further refinements and improvements of the fuel-injection device are described herein.

It is especially advantageous that in addition to the geometrically enabled tilting or pivoting ability of the fuel injector for a compensation of tolerances, guide elements are also provided on the decoupling element, and the rigidity in case of contact at high loads is increased by the lateral guidance of the decoupling element in the receiving bore of the cylinder head. Because of this special outer guidance in the cylinder head with very low play, the tolerance situation is optimally configured. In the event that the fuel injector tilts more than usual in an operation under load, for example as a result of temperature-related elongations, then this is possible because the decoupling element is unable to move relative to the cylinder head in the radial direction.

BRIEF DESCRIPTION OF THE DRAWINGS

Exemplary embodiments of the present invention are shown in the figures in simplified form and are described in greater detail below.

DETAILED DESCRIPTION OF EXAMPLE EMBODIMENTS

Figure 1:
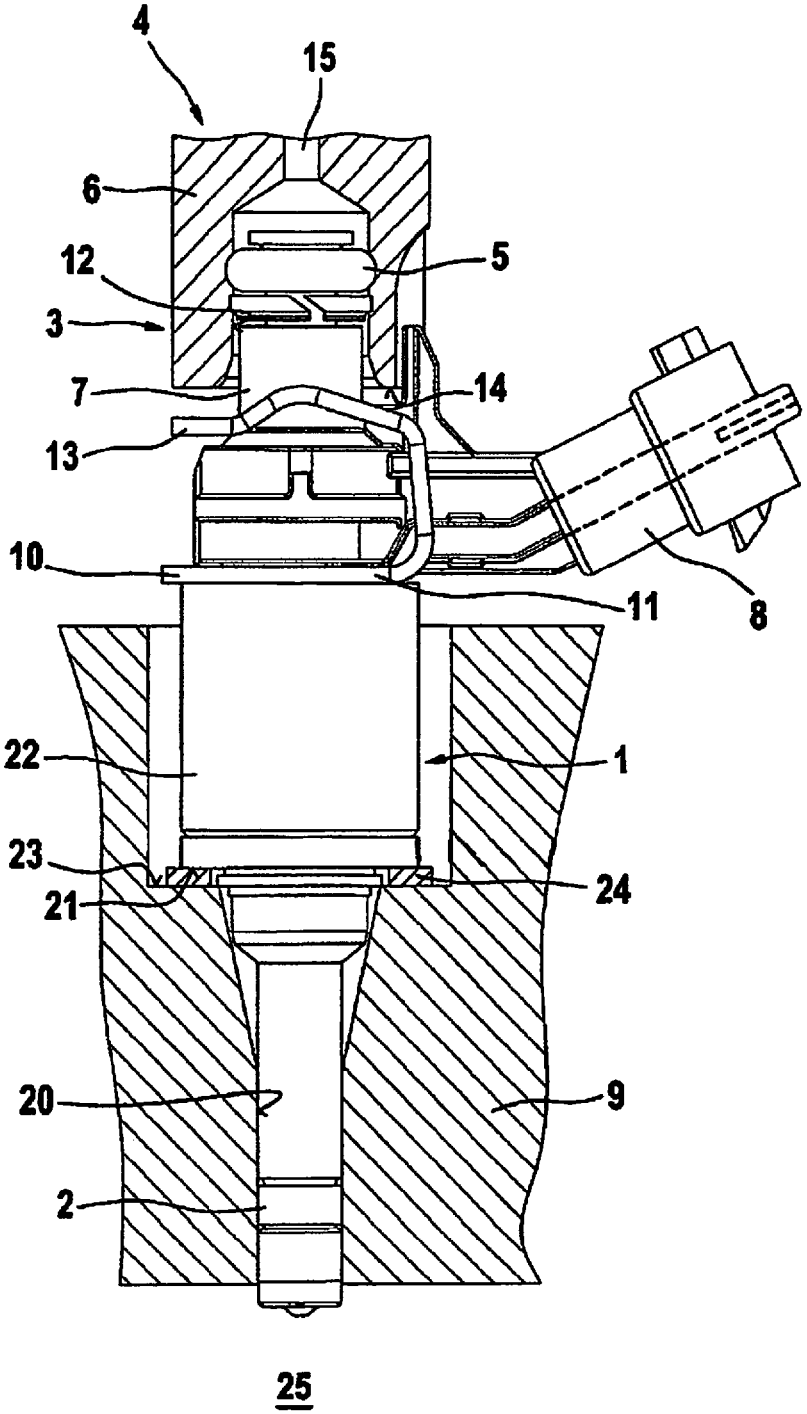
FIG. 1 shows a partially depicted conventional fuel-injection device including a disk-shaped intermediate element.

For an understanding of the present invention, a conventional specific embodiment of a fuel-injection device is described in greater detail below on the basis of FIG. 1. FIG. 1 shows a valve in the form of an injector 1 for fuel-injection systems of mixture-compressing internal combustion engines having externally supplied ignition, as an exemplary embodiment in a side view. Fuel injector 1 is part of the fuel-injection device. Via a downstream end, fuel injector 1, which is implemented in the form of a directly injecting injector for the direct injection of fuel into a combustion chamber 25 of the internal combustion engine, is installed in a receiving bore 20 of a cylinder head 9. A sealing ring 2, in particular made from Teflon®, provides optimum sealing of fuel injector 1 from the wall of receiving bore 20 of cylinder head 9.

A flat intermediate element 24, which is implemented as a bracing element in the form of a washer, is inserted between a step 21 of a valve housing 22 and a shoulder 23, which extends at a right angle to the longitudinal extension of receiving bore 20, for instance. Such an intermediate element 24 makes it possible to compensate for production and installation tolerances and ensures support without transverse forces being exerted even if fuel injector 1 is positioned at a slight tilt.

At its inlet-side end 3, fuel injector 1 has a plug-in connection to a fuel distributor line (fuel rail) 4 that is sealed by a sealing ring 5 between a connecting pipe 6, shown in a sectional view, of fuel-distributor line 4 and an inlet tube 7 of fuel injector 1. Fuel injector 1 is slipped into a receiving bore 12 of connecting pipe 6 of fuel-distributor line 4. Connecting pipe 6, for example, emerges from actual fuel-distributor line 4 in one piece; upstream from receiving bore 12, it has a flow opening 15 of a smaller diameter, by way of which fuel injector 1 is approached by the oncoming flow. Fuel injector 1 is provided with an electrical plug connector 8 for the electrical contacting for the actuation of fuel injector 1.

A hold-down device 10 is provided between fuel injector 1 and connecting pipe 6 in order to set fuel injector 1 and fuel-distributor line 4 apart from each other largely without radial forces being exerted, and to hold fuel injector 1 securely down in the receiving bore of the cylinder head. Hold-down device 10 is implemented as a bow-shaped component such as a stamped and bent part. Hold-down device 10 has a base element 11 in the form of a partial ring, from which a hold-down clamp 13 that rests against a downstream end region 14 of connecting pipe 6 on fuel-distributor line 4 in the installed state, extends at an angle.

In comparison with the conventional intermediate-element solutions, the present invention firstly obtains better noise damping in an uncomplicated manner, above all in the noise-critical idling operation, with the aid of a selective configuration and geometry of intermediate element 24. Secondly, a simple and cost-effective tolerance compensation that allows for tilting of the fuel injector by up to 1° is to be possible and also an operation without the occurrence of transverse forces under thermal influences. The forces (structure-borne noise) introduced into cylinder head 9 during the valve operation represent the relevant noise source of fuel injector 1 in the direct high-pressure injection. These forces lead to a structural excitation of cylinder head 9 and are radiated by cylinder head 9 in the form of airborne sound. To obtain a noise improvement, it is therefore desirable to minimize the forces introduced into cylinder head 9. In addition to reducing the forces induced by the injection, this minimization may be achieved by influencing the transmission behavior between fuel injector 1 and cylinder head 9.

Figure 2:
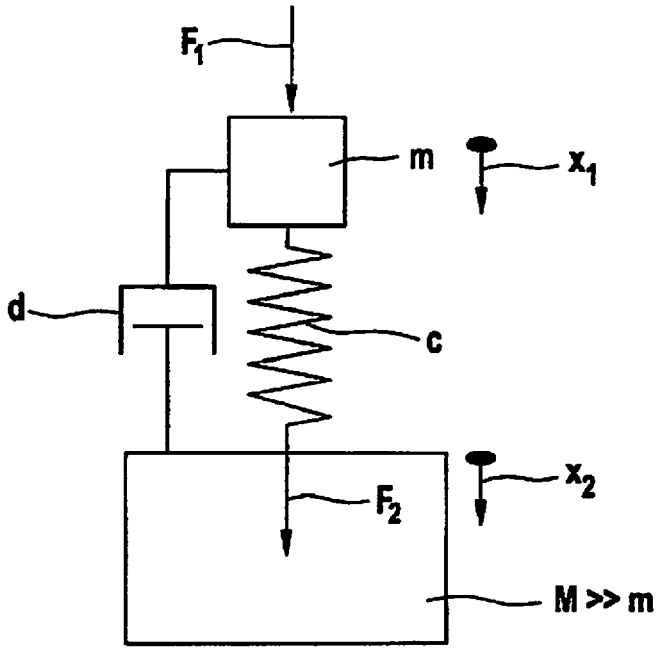
FIG. 2 shows a mechanical equivalent circuit diagram of the bracing of the fuel injector in the cylinder head during the direct injection of fuel, which depicts a conventional spring mass damper system.
Figure 3:
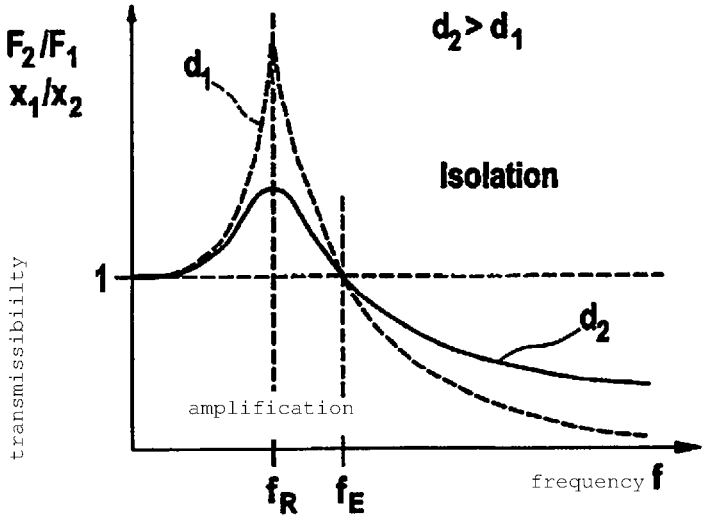
FIG. 3 shows the transmission behavior of a spring mass damper system shown in FIG. 2 with an amplification at low frequencies in the range of resonant frequency $f_R$ and an insulation range above decoupling frequency $f_E$.

In the mechanical sense, the seating of fuel injector 1 on passive intermediate element 24 in receiving bore 20 of cylinder head 9 may be reproduced as a conventional spring mass damper system, as illustrated in FIG. 2. Mass M of cylinder head 9 in comparison with mass m of fuel injector 1 may be assumed as infinitely large in the first approximation. The transmission behavior of such a system is characterized by an amplification at low frequencies in the range of resonant frequency $f_R$ and an isolation range above decoupling frequency $f_E$ (see FIG. 3).

It is the goal of the present invention to configure an intermediate element 24 predominantly using the elastic insulation (decoupling) for noise-reduction purposes, in particular in the idling operation of the vehicle. On the one hand, the present invention encompasses the definition and configuration of a suitable spring characteristic while taking into account the typical requirements and marginal conditions in the direct injection of fuel at a variable operating pressure; on the other hand, it encompasses the configuration of an intermediate element 24, which is able to represent the characteristic of the thusly defined spring characteristic and is able to be adapted to the specific marginal conditions of the injection system through a selection of simple geometric parameters.

The decoupling of fuel injector 1 from cylinder head 9 with the aid of a low spring stiffness c of decoupling element 25, which is implemented in the form of a ring, especially a closed ring, and which features a cushion-type design in cross-section, is made more difficult not only by the small space but also by a restriction of the permissible axial maximum movement of fuel injector 1 during the engine operation. Typically, the following quasi-static load states are encountered in the vehicle:

1. static hold-down force $F_{NH}$ applied by a hold-down device 10 following the installation;
2. force $F_L$ acting at an idling operating pressure; and
3. force $F_{Sys}$ present at a nominal system pressure.

In order to be able to implement the noise-decoupling measures in an uncomplicated and cost-effective manner under typical marginal conditions of the direct injection of fuel (limited space, great forces, low axial overall movement of fuel injector 1), decoupling element 25 with its cushion-type cross-section is furthermore configured across its annular extension in such a way that a lower, e.g., largely planar, end face 26 is provided, which sits on a shoulder 23 of receiving bore 20 in cylinder head 9; in addition, an upper end face 27 is provided, which increases conically from radially outside to radially inside and is in intimate contact with a spherically curved or conically extending shoulder area 21 of valve housing 22 of fuel injector 1. In addition to its conical increase, upper end face 27 of decoupling element 25 may also have a spherical curvature, in which a very large radius exists in the contact region.

Figure 4:
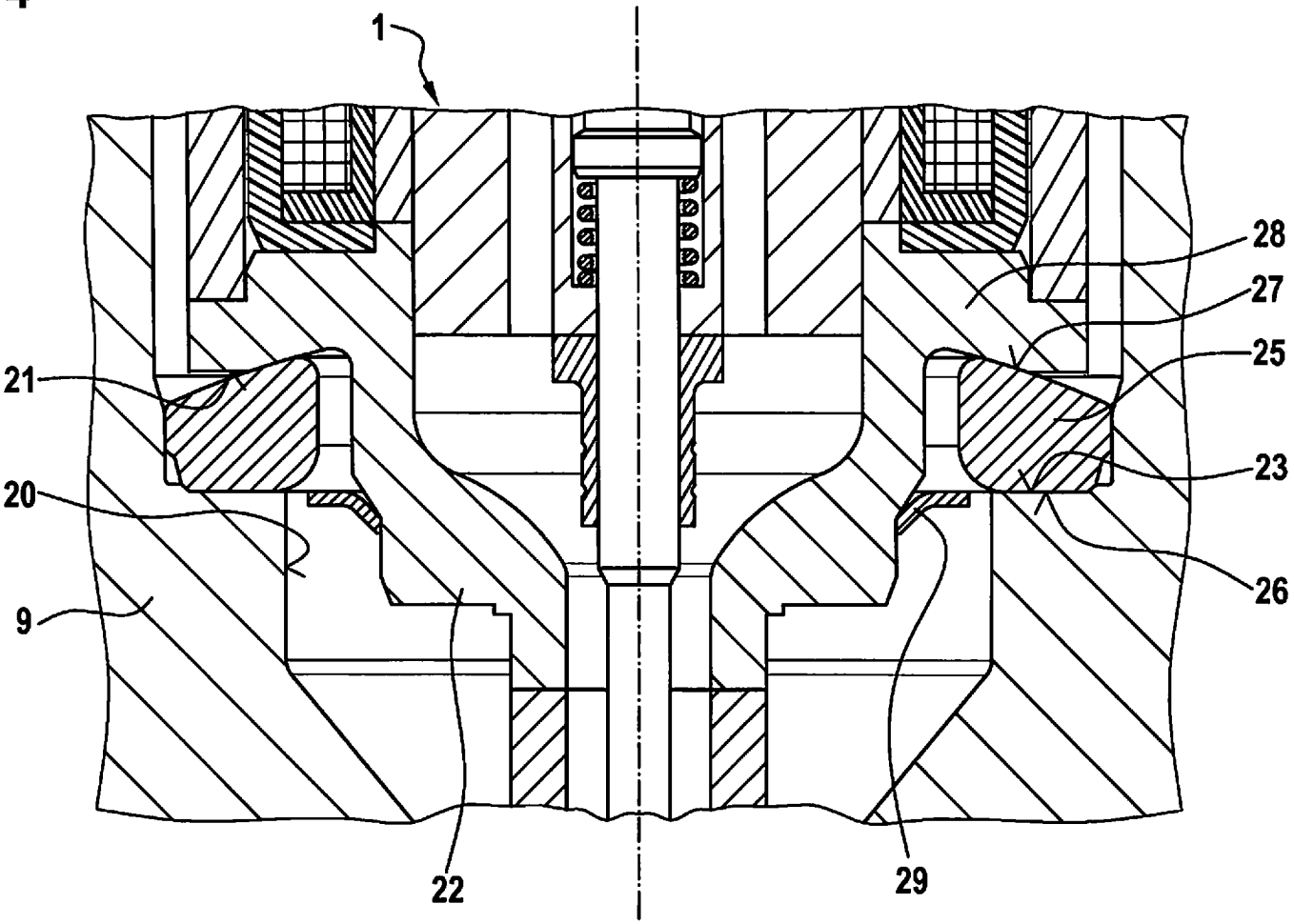
FIG. 4 shows a cross-section through a decoupling element according to the present invention in an installation situation on a fuel injector in the region of the disk-shaped intermediate element shown in FIG. 1.

FIG. 4 shows a cross-section through a decoupling element 25 in an installation position on a fuel injector 1 in the area of disk-shaped intermediate element 24 shown in FIG. 1, intermediate element 24 having been replaced by decoupling element 25 according to the present invention.

In the exemplary embodiment shown, decoupling element 25 has on its topside the conically or coniformly extending end face 27, which in the installed state corresponds to the rounded or spherically implemented, convexly rounded or conical shoulder area 21 of valve housing 22 of fuel injector 1. Shoulder area 21 of valve housing 22 is developed on a radially outwardly positioned shoulder 28, which already provides a certain enchamberment of decoupling element 25 between shoulder 28 and shoulder 23 of receiving bore 20. Shoulder area 21 of valve housing 22 need not have a spherically curved form throughout; it is sufficient if such a shape is provided in the contact region with the conically extending end face 27 of decoupling element 25. The respective transitions of upper end face 27 and lower end face 26 with regard to the two inner and outer annular lateral areas of decoupling element 25 may be rounded. The geometry according to the present invention featuring a flat angle or a large radius of the curvature at spherically curved shoulder area 21 of valve housing 22, and conically or coniformly extending end face 27 of decoupling element 25 in conjunction with a relatively large play radially inwardly in the direction of fuel injector 1 and with very little play radially outwardly in the direction of the wall of receiving bore 20, allows for the use of an injectable plastic element or a cold-shaped aluminum element. Such a decoupling element 25 is able to be produced in a cost-effective manner and decouples the structure-borne noise in the desired manner.

Together with the slightly convexly shaped shoulder area 21 of valve housing 22, a pivotable or tiltable connection is created for the compensation of tolerances. In case of an offset between fuel injector 1 and receiving bore 20 within the framework of the tolerated production fluctuations, slight tilting of fuel injector 1 may occur. Because of the pivotable connection between fuel injector 1 and decoupling element 25, transverse forces in case of a tilted position of fuel injector 1 are then largely avoided. Cone/cone, cone/sphere, sphere/cone or sphere/cone-pairings of valve housing 22 and decoupling element 25 are possible according to the present invention.

A loss protection for decoupling element 25 may be assumed by a securing ring 29, which is situated below decoupling element 25 and grasps decoupling element 25 from below with a small clearance and is fixed in place on valve housing 22 of fuel injector 1. In this way it can be ensured that fuel injector 1 is able to be installed as a modular unit together with decoupling element 25 in receiving bore 20.

Figure 5:
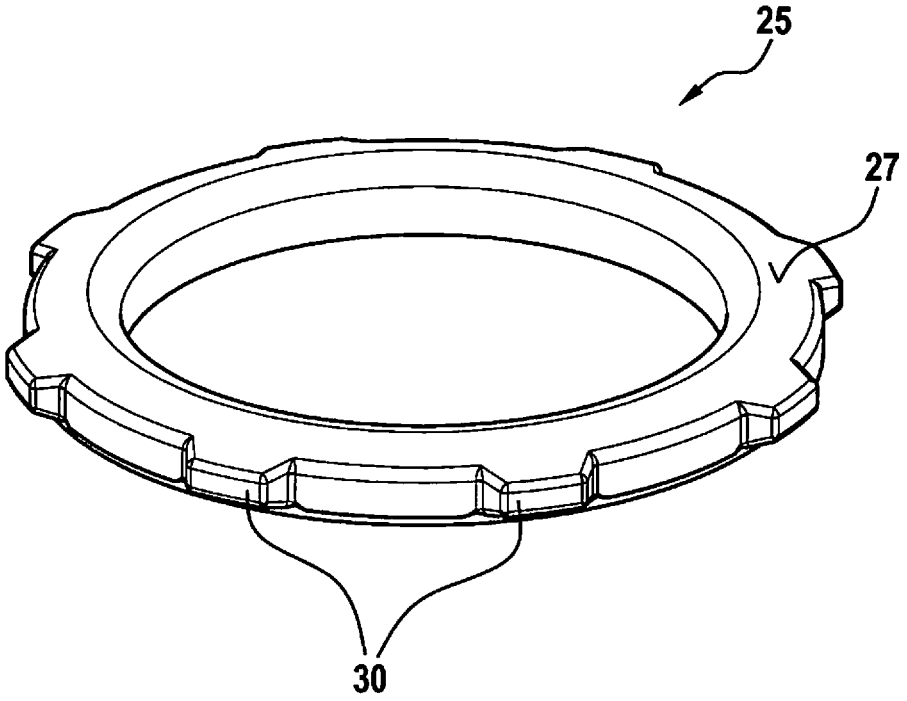
FIG. 5 shows a decoupling element according to the present invention as an individual component in an oblique plan view.

FIG. 5 shows a decoupling element 25 according to the present invention as an individual component in an oblique plan view. Next to the conically extending upper end face 27 of decoupling element 25, it can be seen that at least one guide element 30, in particular between three and twelve guide elements 30 in the form of guide collars that project in the form of noses, is/are provided as a special design feature, which radially project(s) at the outer periphery. Because of this special outer guidance of decoupling element 25 in receiving bore 20 of cylinder head 9 with very little play, the tolerance situation is managed in an optimal manner. In the event that fuel injector 1 tilts more than usual in an operation under load, e.g., due to temperature-related expansions, then this is possible because decoupling element 25 is unable to move relative to cylinder head 9 in the radial direction.

Figure 6:
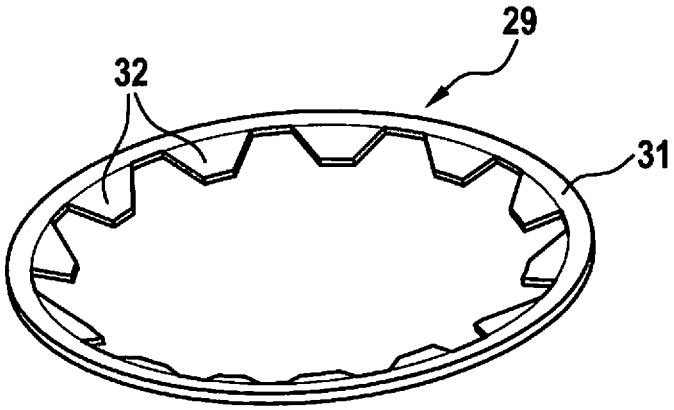
FIG. 6 shows a securing ring as an individual component in an oblique plan view.

FIG. 6 shows an optional securing ring 29 as an individual component in an oblique plan view. For example, securing ring is developed as a closed ring, which extends at an angle in cross-section; an upper, largely planar ring collar 31 has a circumferential form, from which a plurality of bracing tabs 32 that are distributed across the periphery and rest against valve housing 22 extend at an angle. Securing ring 29 may also have a different design and be disposed on the outer periphery of fuel injector 1 at some other distance from decoupling element 25. In particular, securing ring 29 may be realized as a compact, solid, uninterrupted plastic ring that includes different functional regions through its filigree outer contour.

Figure 7:
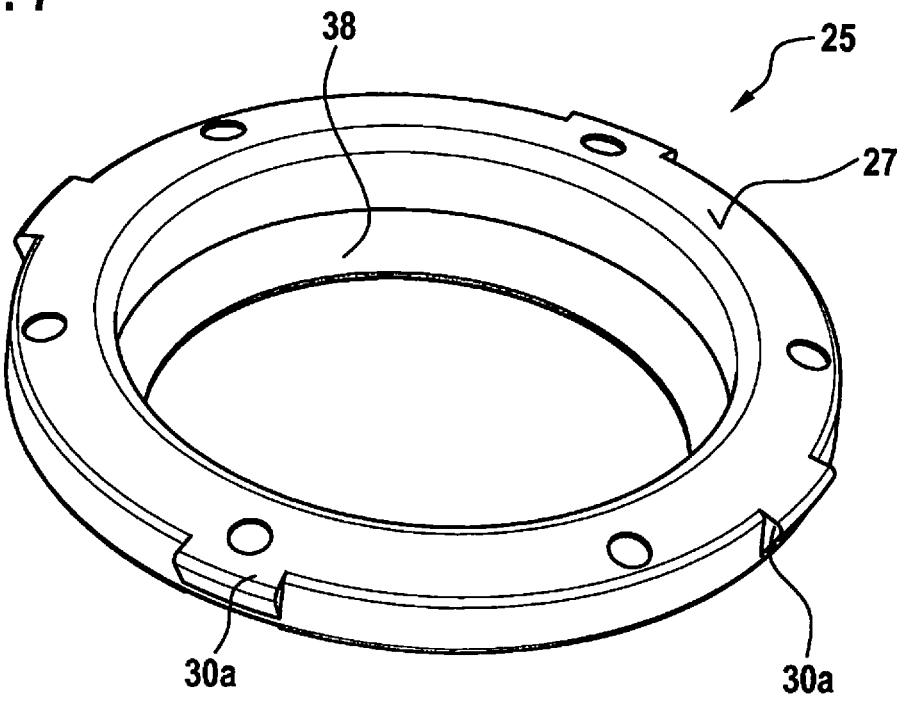
FIGS. 7 and 8 show an alternative decoupling element according to the present invention as an individual component in an oblique plan view and an oblique view from below.
Figure 8:
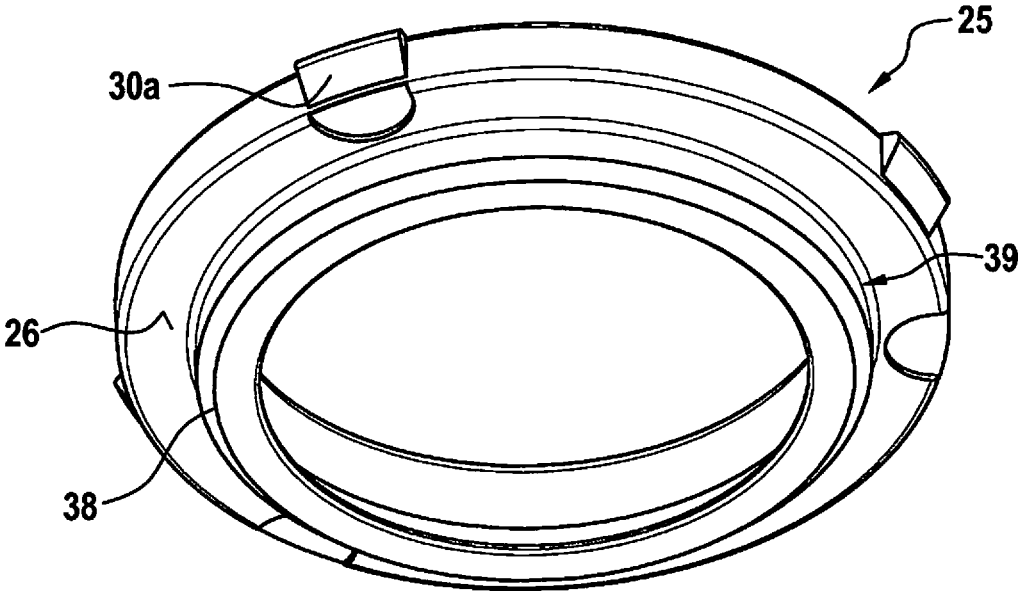

An alternative decoupling element 25 is shown by FIGS. 7 and 8. A collar 38 on securing element 25, the collar having a slanted design and projecting beyond shoulder 23 of receiving bore 20 in the direction of securing ring 29, is able to ensure even better stabilizing of decoupling element 25 in the event of tilting and allows for the very compact development of securing ring 29 because decoupling element 25 is already securely gripped from below in the region of collar 38 at very small radial dimensions of securing ring 29. Instead of guide elements 30 in the extension region of decoupling element 25 having the greatest diameter, an annular guide element 39 is thereby able to be provided at the outer diameter of collar 38 having the smaller diameter. In other words, guide element 39 is an outer cylindrical annular region of collar 38, which corresponds to the wall of receiving bore 20 in cylinder head 9 below shoulder 23 for the radial positioning. Radial guide elements 30 at the larger diameter are now no longer required. To allow a precise insertion of collar 38 with guide element 39 during the installation of fuel injector 1 with decoupling element 25 in receiving bore 20 into said receiving bore 20, it may be useful if instead of guide elements 30, a plurality, such as four, pre-centering noses 30*a* are premolded at the largest diameter of decoupling element 25. With the aid of collar 38, the loss-protection of decoupling element 25 is able to be optimally designed in terms of geometry and functionality via securing ring 29, inasmuch as it is able to be produced and installed in a cost-effective manner, requires little space, and allows for the required play for slight tilting.

What is claimed is:

1. A decoupling element designed for arrangement between a housing of a fuel injector and a wall of a receiving bore in which the fuel injector is received for fuel injection into a combustion chamber, the decoupling element comprising:

a closed ring, wherein:

the closed ring is designed to be arranged with:

a lower end face of the closed ring sitting on a shoulder of the receiving bore; and an upper end face of the closed ring being conically or spherically shaped, sloping upward from radially outside toward radially inside, and being in contact with a spherically curved or conical shoulder area of the housing of the fuel injector; and at least one of:

respective transitions of the upper end face and the lower end face toward inner and outer annular lateral areas of the closed ring are rounded;

at least one guide element radially projects at an outer periphery of the closed ring; and the decoupling element further includes at least one of:

a collar that axially projects from the closed ring and that includes an annular guide element at an outer periphery of the collar; and a securing ring that includes a circumferential ring collar from which a plurality of bracing tabs, that are distributed across its periphery, extend.

2. The decoupling element as recited in claim 1, wherein the decoupling element is an injection-molded plastic element or a cold-formed aluminum element.

3. A device comprising:

a fuel injector;

a chamber head including a receiving bore in which the fuel injector is received;

a closed ring that is arranged between a housing of the fuel injector and a wall of the receiving bore, wherein:

a lower end face of the closed ring sits on a shoulder of the receiving bore;

an upper end face of the closed ring is conically or spherically shaped and is in contact with a spherically curved or conical downwardly facing shoulder end face of the housing of the fuel injector;

at a point of the contact, each of the upper end face of the closed ring and the downwardly facing end face of the housing of the fuel injector radially interiorly slopes upward; and a larger play exists radially inwardly of the closed ring, between the closed ring and the fuel injector than exists radially outwardly of the closed ring, between the closed ring and the wall of the receiving bore.

4. The decoupling element as recited in claim 1, wherein the respective transitions of the upper end face and the lower end face toward the inner and outer annular lateral areas of the closed ring are rounded.

5. The decoupling element as recited in claim 1, wherein the at least one guide element radially projects at an outer periphery of the closed ring.

6. The decoupling element as recited in claim 1, wherein the decoupling element further includes the collar that axially projects from the closed ring and that includes the annular guide element at the outer periphery of the collar.

7. The decoupling element as recited in claim 6, wherein a plurality of pre-centering noses are premolded at a largest diameter of the closed ring.

8. The decoupling element as recited in claim 1, wherein the decoupling element includes the securing ring that includes the circumferential ring collar from which the plurality of bracing tabs, that are distributed across its periphery, extend.

9. The decoupling element as recited in claim 3, wherein the upper end face is in pivotable or tiltable contact the housing.

10. The decoupling element as recited in claim 1, wherein the chamber head is a cylinder head of a combustion chamber, and the shoulder of the receiving bore extends perpendicularly to an extension of a central longitudinal axis of the receiving bore.

11. The decoupling element as recited in claim 5, wherein the at least one guide element includes three to twelve guide elements.

12. The decoupling element as recited in claim 6, wherein the collar projects from a radially interior edge of the closed ring.

13. The decoupling element as recited in claim 12, wherein a plurality of pre-centering noses are premolded at a largest diameter of the closed ring.

14. The decoupling element as recited in claim 8, wherein the plurality of bracing tabs extend from the ring collar at an angle that is oblique relative to a central longitudinal axis of the ring collar.

15. The decoupling element as recited in claim 8, wherein the plurality of bracing tabs extend radially interiorly from the ring collar.

16. The decoupling element as recited in claim 8, wherein the ring collar includes a planar surface.

17. A device comprising:

a fuel injector;

a chamber head including a receiving bore in which the fuel injector is received;

a closed ring that is arranged between a housing of the fuel injector and a wall of the receiving bore, wherein:

a lower end face of the closed ring sits on a shoulder of the receiving bore;

an upper end face of the closed ring is in contact with a shoulder of the housing of the fuel injector; and any one or more of the following four features (a)-(d):

(a) in a first axial region, a clearance between (1) a radially interior side surface of the closed ring and (2) a radially exterior surface of the fuel injector facing the radially interior side surface of the closed ring is greater than a clearance between (1) a radially exterior side surface of the closed ring and (2) a portion of the wall of the receiving bore facing the radially exterior side surface of the closed ring;

(b) the closed ring includes radially outwardly extending projections that project laterally towards the wall of the receiving bore;

(c) a clearance between (1) a most radially-exterior edge of the closed ring in the region below the shoulder of the receiving bore and (2) a portion of the wall of the receiving bore facing the most-radially exterior edge of the closed ring in the region below the shoulder of the receiving bore is different than a clearance between (1) a most radially-exterior edge of the closed ring in a region above the shoulder of the receiving bore and (2) a portion of the wall of the receiving bore facing the most-radially exterior edge of the closed ring in the region above the shoulder of the receiving bore; and (d) the device further comprises a securing ring, and the securing ring at least one of:

(1) contacts an underside surface of the closed ring and one or both of the following:

(i) extends radially inwardly from beneath the underside surface of the closed ring, beyond a most-radially interior edge of the closed ring, to a radially interior edge of the securing ring at which the securing ring contacts the housing of the fuel injector; and (ii) is braced against the housing of the fuel injector below the shoulder of the receiving bore; and (2) includes a circumferential ring collar from which a plurality of tabs extend radially inwardly.

18. The device as recited in claim 17, wherein:

the closed ring includes a downwardly extending projection that projects into the region below the shoulder of the receiving bore; and the clearance between (1) the most radially-exterior edge of the closed ring in the region below the shoulder of the receiving bore and (2) the portion of the wall of the receiving bore facing the most-radially exterior edge of the closed ring in the region below the shoulder of the receiving bore is different than the clearance between (1) the most radially-exterior edge of the closed ring in the region above the shoulder of the receiving bore and (2) the portion of the wall of the receiving bore facing the most-radially exterior edge of the closed ring in the region above the shoulder of the receiving bore.

19. The device as recited in claim 18, wherein the clearance between (1) the most radially-exterior edge of the closed ring in the region above the shoulder of the receiving bore and (2) the portion of the wall of the receiving bore facing the most-radially exterior edge of the closed ring in the region above the shoulder of the receiving bore is greater than the clearance between (1) the most radially-exterior edge of the closed ring in the region below the shoulder of the receiving bore and (2) the portion of the wall of the receiving bore facing the most-radially exterior edge of the closed ring in the region below the shoulder of the receiving bore, and the smaller clearance below the shoulder of the receiving bore is between the downwardly extending projection and the wall of the receiving bore.

20. The device as recited in claim 17, wherein the device further comprises the securing ring that contacts the underside surface of the closed ring and extends radially inwardly from beneath the underside surface of the closed ring, beyond the most-radially interior edge of the closed ring, to the radially interior edge of the securing ring at which the securing ring contacts the housing of the fuel injector.

* * * * *